US006334692B1

(12) United States Patent
Hsueh

(10) Patent No.: US 6,334,692 B1
(45) Date of Patent: Jan. 1, 2002

(54) DECORATIVE MEMBER HAVING VIBRATION ACTUATING LIGHT

(76) Inventor: Yeong-Shyan Hsueh, 6F, No. 440-2, Gin Pin Road, Chong Ho City, Taipei Hsien (TW), 235

( * ) Notice: Subject to any disclaimer, the term of this patent is extended or adjusted under 35 U.S.C. 154(b) by 0 days.

(21) Appl. No.: 09/671,834

(22) Filed: Sep. 25, 2000

(51) Int. Cl.[7] ..... F21V 33/00

(52) U.S. Cl. ..... 362/116; 362/802; 362/394; 362/203; 200/61.52; 200/276

(58) Field of Search ..... 362/116, 802, 362/203, 204, 205, 206, 394; 200/61.51, 61.52, 276

(56) References Cited

U.S. PATENT DOCUMENTS 5,786,553 A * 7/1998 Zakutin ..... 200/61.48
5,897,200 A * 4/1999 Ho ..... 362/259

* cited by examiner

*Primary Examiner*—Alan Cariaso
*Assistant Examiner*—Hargobind S. Sawhney

(57) ABSTRACT

A decorative member includes a housing having a chamber for receiving a frame of a light device. A sleeve is secured on one end of the frame. A spring is secured in the sleeve, a light member is electrically coupled between the spring and the frame. A lid is secured on the sleeve and spaced from the spring for electrically contacting with the spring when the spring is vibrated, and for generating a twinkling light when the spring is intermittently contacted with the lid. The housing may be attached to various kinds of objects for generating twinkling lights for the objects.

7 Claims, 9 Drawing Sheets

DECORATIVE MEMBER HAVING VIBRATION ACTUATING LIGHT

BACKGROUND OF THE INVENTION

1. Field of the Invention

The present invention relates to a decorative member, and more particularly to a decorative member having a light device actuated by vibrations or shocks of the decorative member.

2. Description of the Prior Art

Typical decorative members may include one or more light devices provided therein and controlled by one or more switches. The light devices may be actuated only when the switches are actuated. However, once the light devices are actuated by the switches, the light devices may not be turned off until the switches are actuated again, such that electricity may be wasted.

The present invention has arisen to mitigate and/or obviate the afore-described disadvantages of the conventional decorative members.

SUMMARY OF THE INVENTION

The primary objective of the present invention is to provide a decorative member having a light device that may be actuated or energized by the vibrations or the shocks of the decorative member for generating a twinkling light.

In accordance with one aspect of the invention, there is provided a decorative member comprising a housing including a chamber formed therein, a frame including a first end having a sleeve secured thereon, and including a second end, a first spring secured in the sleeve, a lid secured on the sleeve and spaced from the first spring for electrically contacting with the first spring when the first spring is vibrated, a light member including a first terminal electrically coupled to the first spring and including a second terminal electrically coupled to the frame, and at least one battery received in the second end of the frame and including a first electrode electrically coupled to the second end of the frame, and including a second electrode electrically coupled to the lid. The lid and the second electrode of the battery may be electrically coupled to the first terminal of the light member via the first spring, in order to generate a twinkling light when the first spring is intermittently contacted with the lid.

A non-conductive spacer is selectively engaged between the battery and the second end of the frame for de-energizing the light member.

A cover is further secured to the housing and includes a slot formed therein for receiving the spacer. A casing is engaged on the frame and includes a slit formed therein and aligned with the slot of the cover for receiving the spacer.

A conductive barrel is received in the sleeve and electrically coupled to the lid and spaced from the first spring for intermittently engaging with the first spring. A canopy is engaged on the light member. A second spring is engaged between the lid and the second electrode of the battery.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 7:
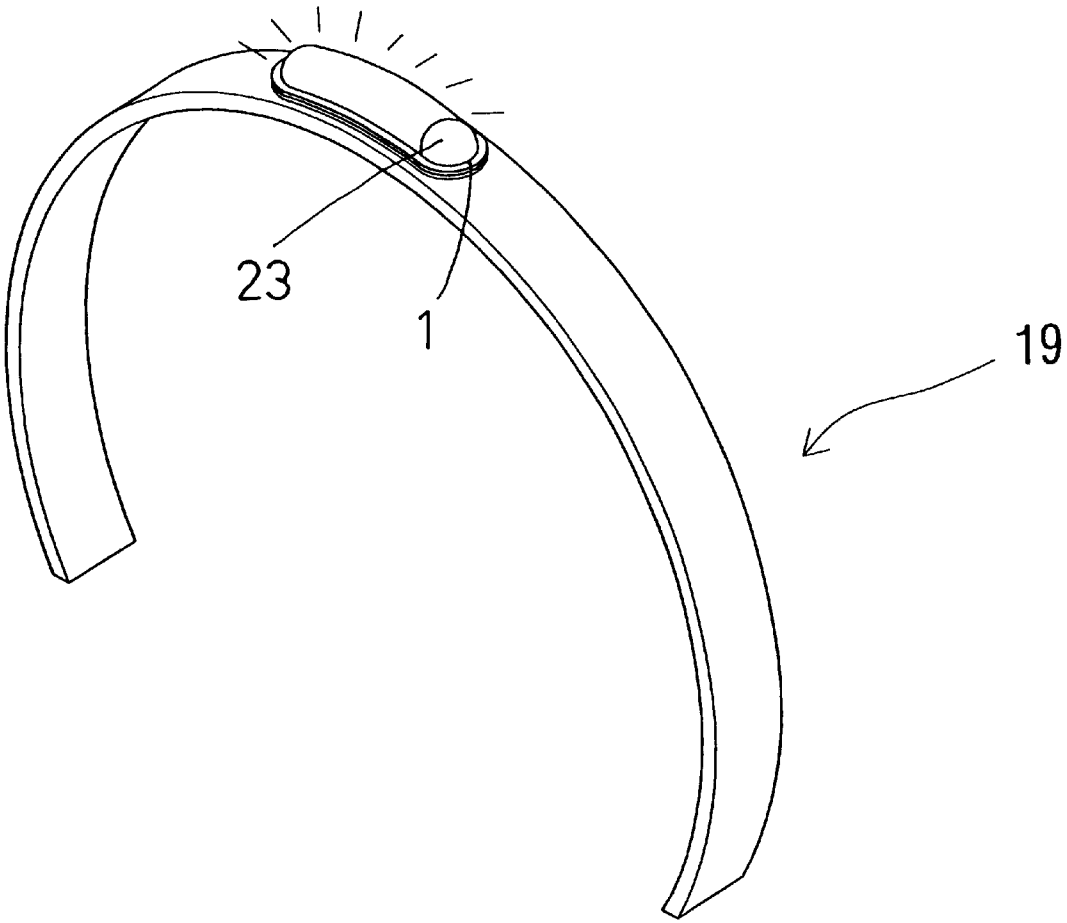
FIGS. 7, 8, 9 and 10 are perspective views illustrating the application of the decorative member.
Figure 8:
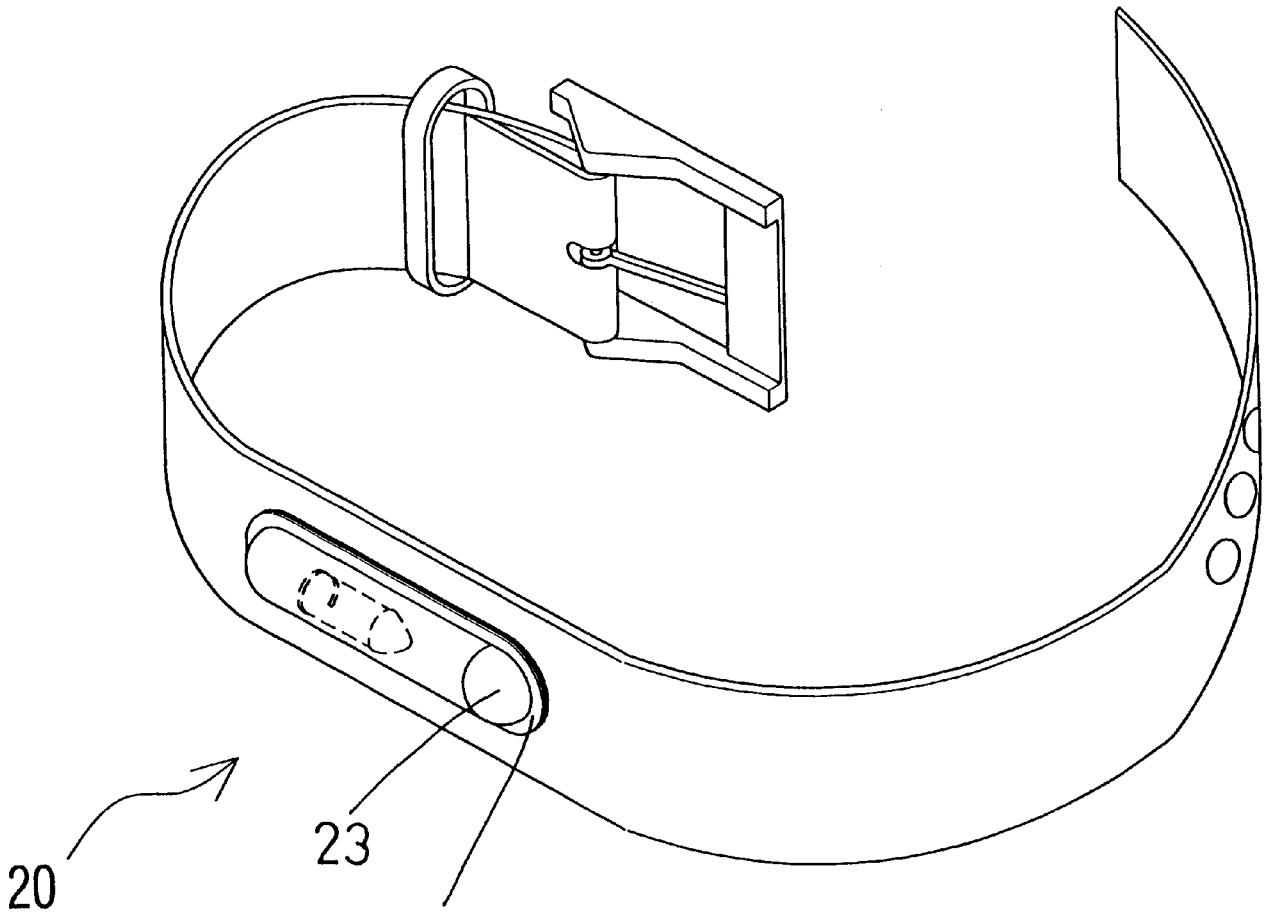
Figure 9:
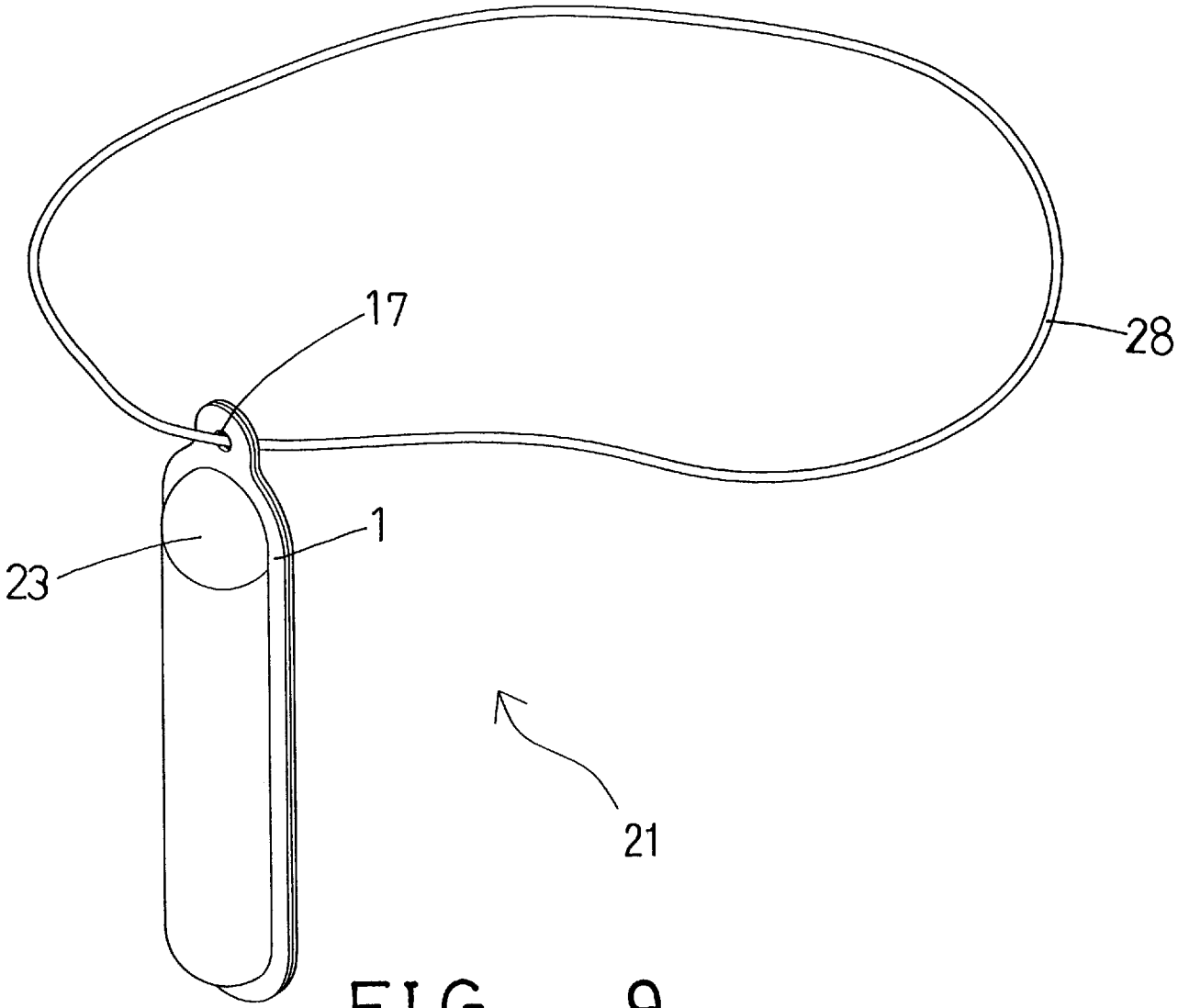
Figure 10:
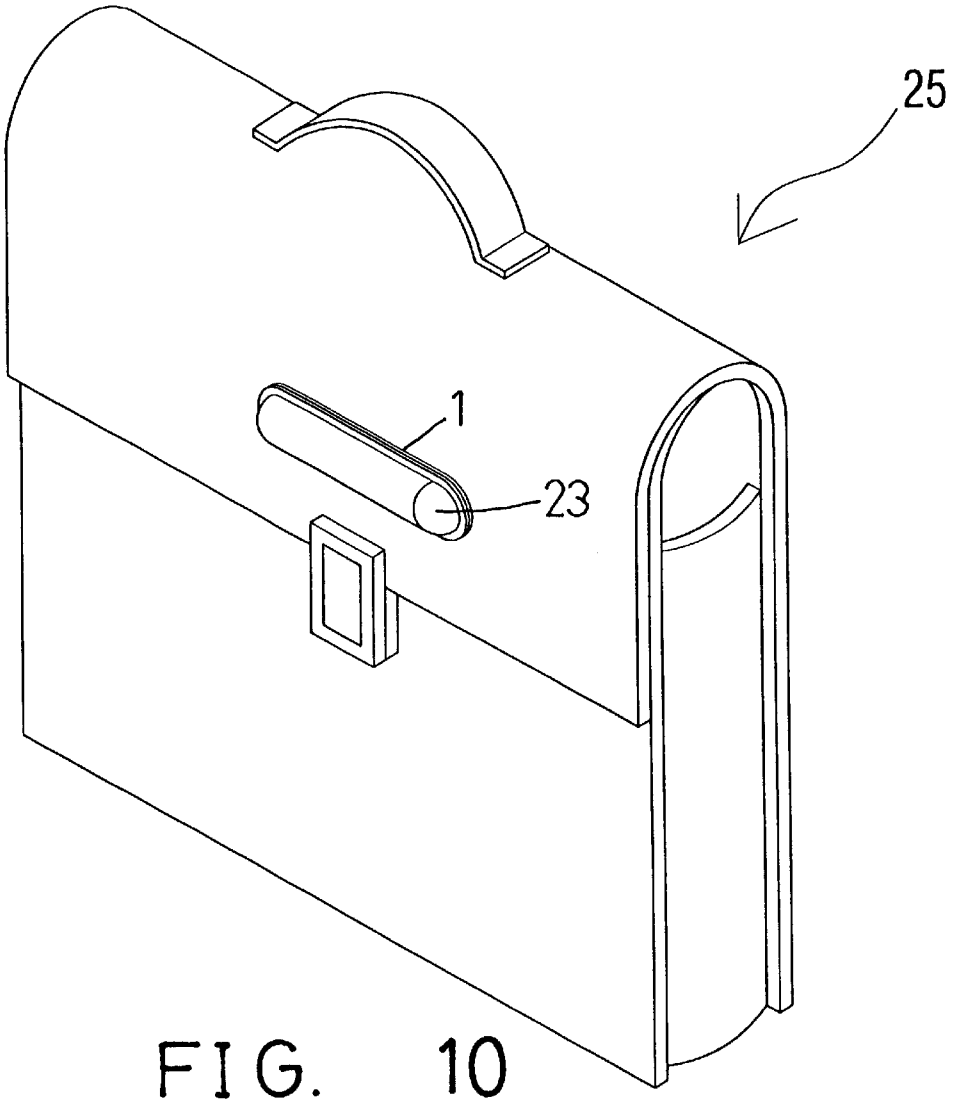

Referring to the drawings, and initially to FIGS. 1–4, a decorative member in accordance with the present invention comprises a housing 1 and a cover 2 secured together with an adhesive material, or the other fasteners, or by a welding process, etc. The housing 1 and the cover 2 each includes a hole 17 formed therein for attaching a key ring 16 or a circular wire member 28 (FIG. 9), or the like. The housing 1 includes a chamber 22 formed therein for receiving a light device therein. The cover 2 includes a slot 15 formed therein. The decorative member may be attached onto a clamping ring 19 (FIG. 7), or a watch belt 20 (FIG. 8), or a schoolbag 25 (FIG. 10), etc., with an adhesive material, a hook and loop device, or the other fasteners, or the like.

The light device includes a casing 7 received in the chamber 22 of the housing 1 and includes a bore 14 formed therein, and includes a slit 8 formed therein and aligned with the slot 15 of the cover 2. A frame 6 is conductive. A con-conductive cap 27 and a non-conductive sleeve 5 are secured on one end of the frame 6. A spring 12 is secured in the sleeve 5. A light member 4, such as a light emitting diode, a light crystal displayer, or the like, is secured on the one end of the frame 6 and has one terminal or one leg thereof electrically coupled to the spring 12, and has the other terminal or the other leg electrically coupled to the frame 6. A conductive barrel 26 is engaged in the sleeve 5 and a conductive lid 11 is secured to the barrel 26 and spaced from the spring 12. A spring 18 is secured to the lid 11 and electrically coupled to the center electrode of one or more batteries 10. The case electrode of the batteries 10 is electrically coupled to the frame 6.

Figure 1:
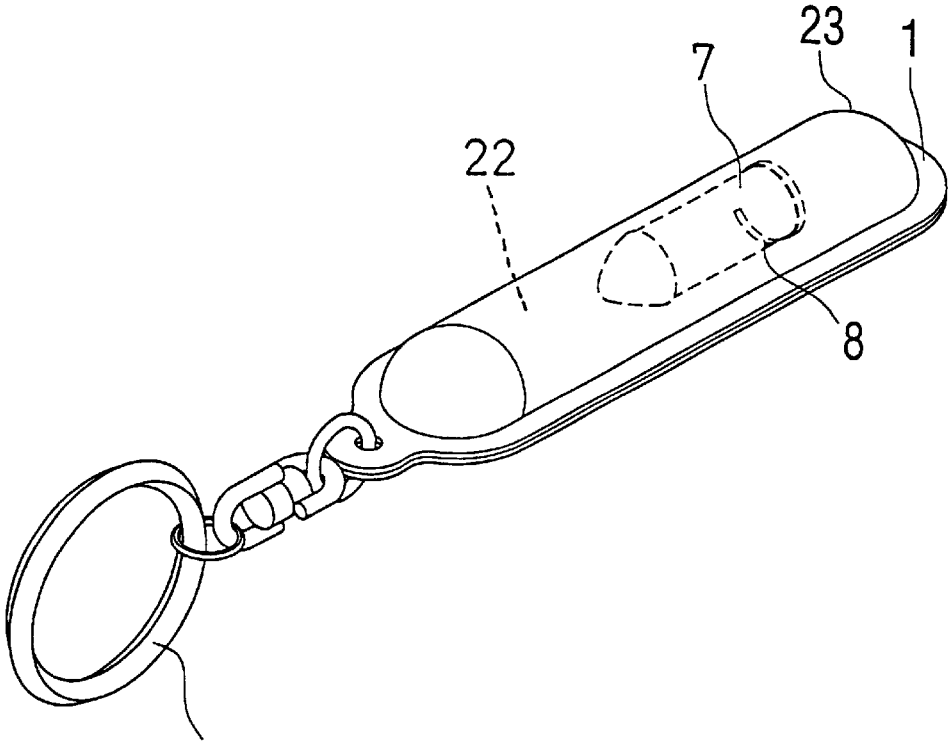
FIG. 1 is an upper perspective view of a decorative member in accordance with the present invention.
Figure 2:
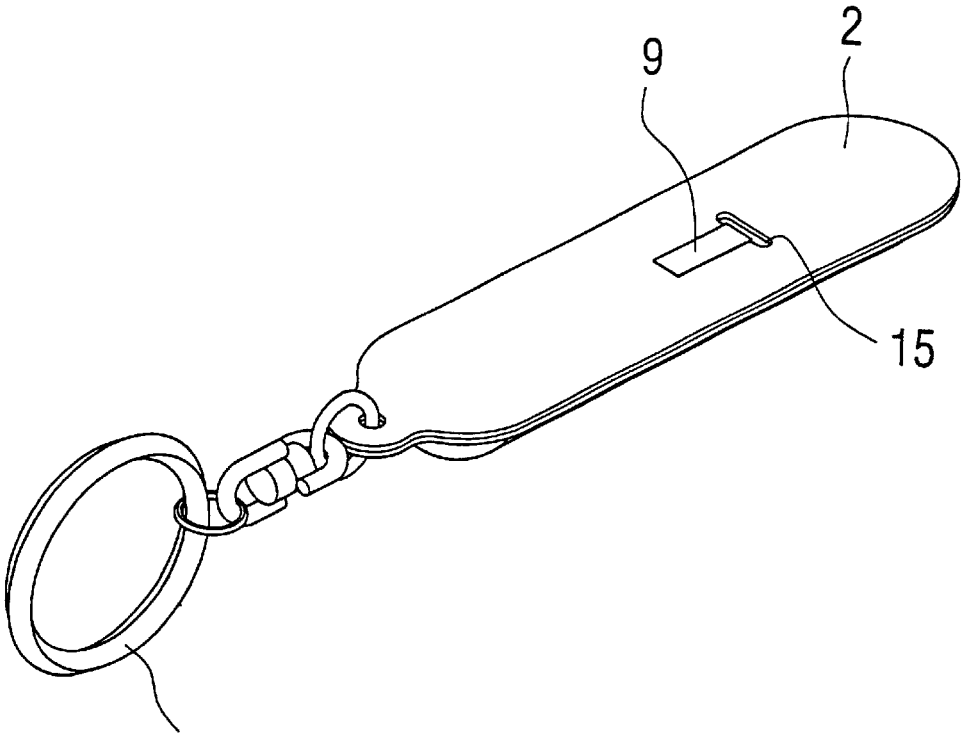
FIG. 2 is a bottom perspective view of a decorative member.
Figure 3:
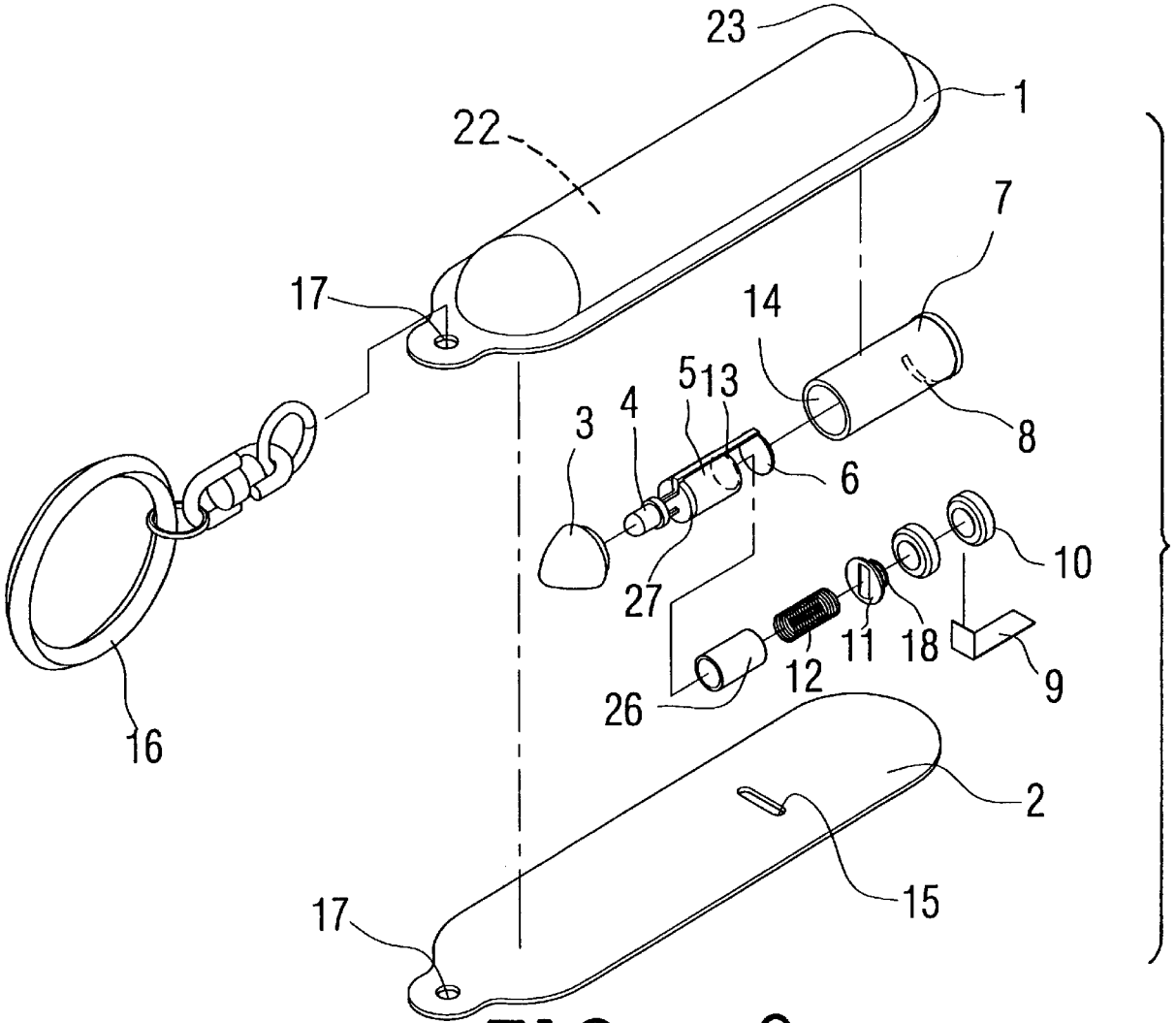
FIG. 3 is an exploded view of the decorative member.
Figure 4:
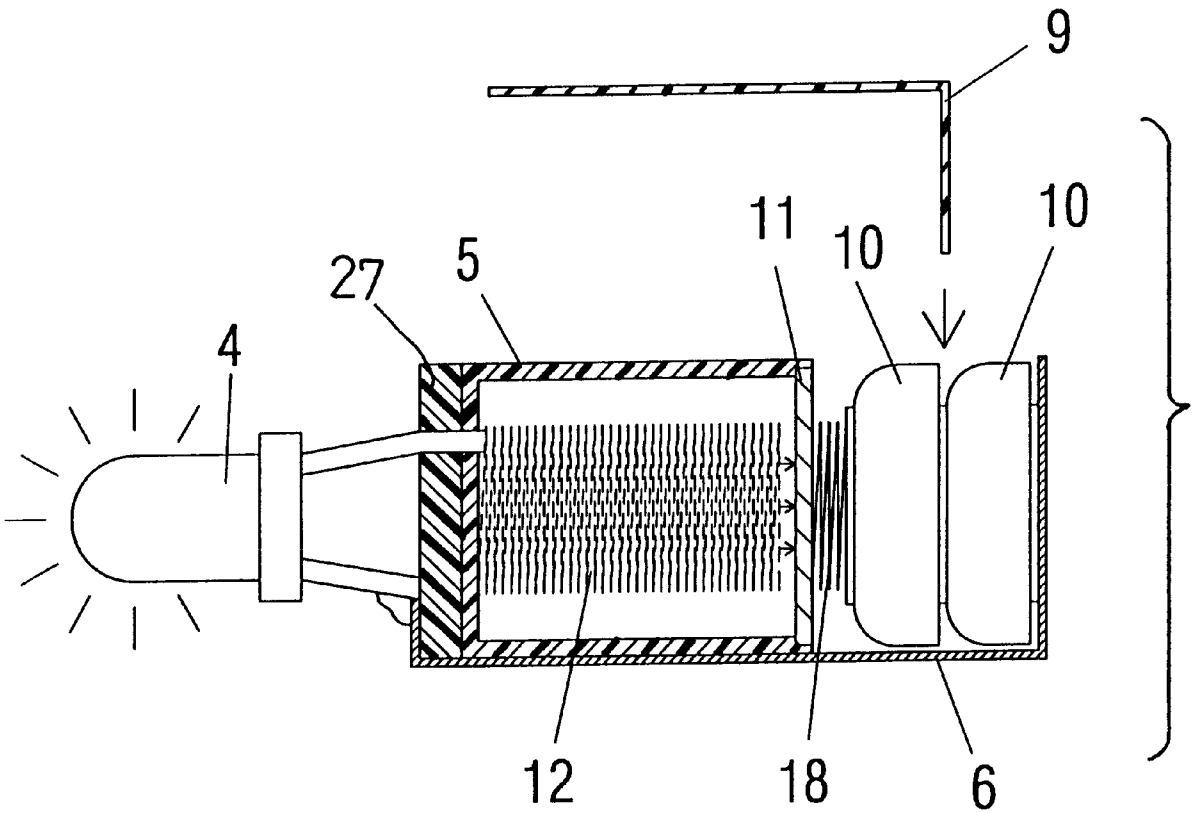
FIG. 4 is a partial cross sectional view of the light device for the decorative member.

In operation, as shown in FIG. 4, when the decorative member, or when the housing 1 is vibrated or moved, the spring 12 may move or vibrate here and there and may electrically contact with the conductive barrel 26 or the conductive lid 11 intermittently in order to generate a twinkling light. A spacer 9 may be engaged through the slot 15 of the cover 2 and the slit 8 of the casing 7 and may be engaged into the batteries 10, or may be engaged between the battery 10 and the frame 6 for separating the battery 10 from the frame 6, such that the light member 4 will not be energized whether the spring 12 is contacted with the conductive barrel 26 or the conductive lid 11 or not. The light member 4 may be energized by intermittently contacting the spring 12 with the conductive barrel 26 or the conductive lid 11 when the spacer 9 is disengaged from the batteries 10 again.

The housing 1 is preferably made of transparent or semi-transparent material having various kinds of colors applied thereon for generating various kinds of colors of lights when the light member 4 is energized. Alternatively, the housing 1 may includes only a portion 23 aligned with the light member 4 and made of transparent or semi-transparent material having various kinds of colors applied thereon. A transparent or semi-transparent canopy 3 may further be provided and engaged onto the light member 4.

Figure 5:
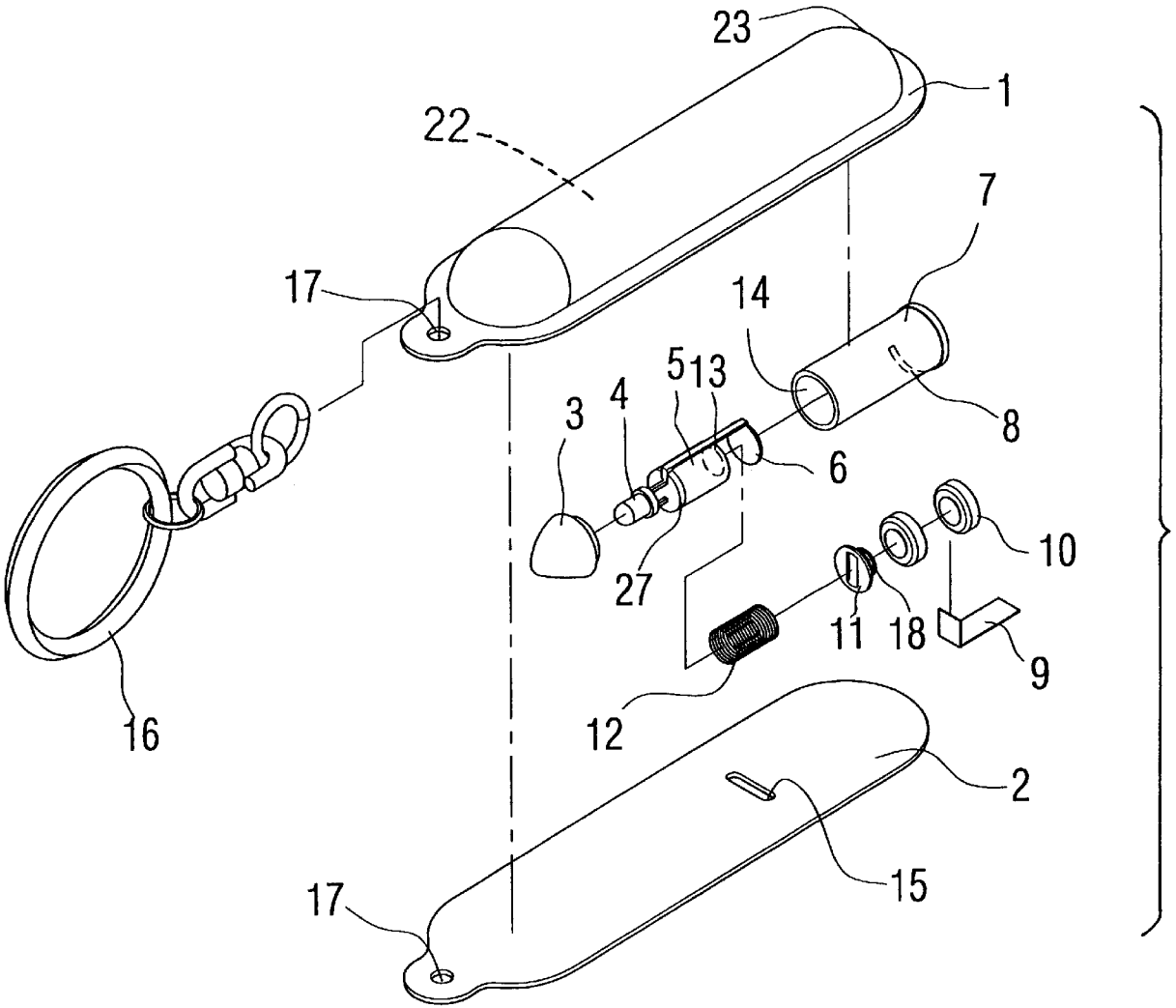
FIG. 5 is an exploded view similar to FIG. 3, illustrating the other application of the decorative member.
Figure 6:
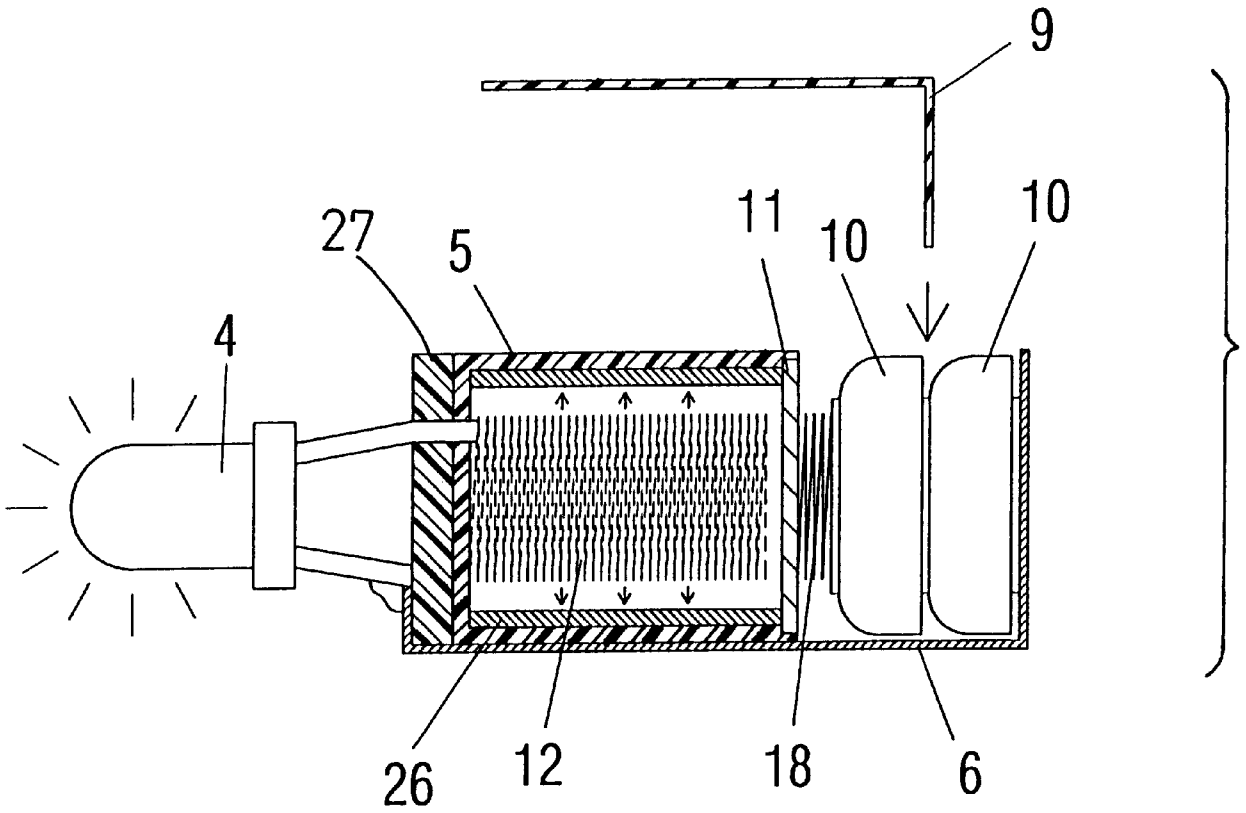
FIG. 6 is a partial cross sectional view of the light device as shown in FIG. 5 for the decorative member.

Referring next to FIGS. 5 and 6, without the conductive barrel 26, the spring 12 may be engaged with the conductive lid 11 intermittently in order to electrically couple the center electrode of the batteries 10 to the spring 12 intermittently and in order to generate a twinkling light.

Accordingly, the decorative member in accordance with the present invention includes a light device that may be actuated or energized by the vibrations or the shocks of the decorative member for generating a twinkling light.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A decorative member comprising:

a housing including a chamber formed therein, a frame including a first end having a sleeve secured thereon, and including a second end, a first spring secured in said sleeve, a lid secured on said sleeve and spaced from said first spring for electrically contacting with said first spring when said first spring is vibrated, a light member including a first terminal electrically coupled to said first spring and including a second terminal electrically coupled to said frame, and at least one battery received in said second end of said frame and including a first electrode electrically coupled to said second end of said frame, and including a second electrode electrically coupled to said lid, said lid and said second electrode of said at least one battery being electrically coupled to said first terminal of said light member via said first spring when said first spring is intermittently contacted with said lid.

2. The decorative member according to claim 1 further comprising a non-conductive spacer selectively engaged between said at least one battery and said second end of said frame.

3. The decorative member according to claim 2 further comprising a cover secured to said housing and including a slot formed therein for receiving said spacer.

4. The decorative member according to claim 3 further comprising a casing engaged on said frame and including a slit formed therein and aligned with said slot of said cover for receiving said spacer.

5. The decorative member according to claim 1 further comprising a conductive barrel received in said sleeve and electrically coupled to said lid and spaced from said first spring for intermittently engaging with said first spring.

6. The decorative member according to claim 1 further comprising a canopy engaged on said light member.

7. The decorative member according to claim 1 further comprising a second spring engaged between said lid and said second electrode of said at least one battery.

* * * * *